US009836006B2

(12) United States Patent
Dobashi

(10) Patent No.: US 9,836,006 B2
(45) **Date of Patent: *Dec. 5, 2017**

(54) SHEET POST-PROCESSING APPARATUS AND IMAGE FORMING SYSTEM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Shoichi Dobashi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,801

(22) Filed: Aug. 22, 2016

(65) Prior Publication Data

US 2016/0357139 A1 Dec. 8, 2016

Related U.S. Application Data

(63) Continuation of application No. 14/640,104, filed on Mar. 6, 2015, now Pat. No. 9,454,122.

(51) Int. Cl.
*G03G 15/00* (2006.01)
*B65H 29/12* (2006.01)
(Continued)

(52) U.S. Cl.
CPC ..... *G03G 15/6582* (2013.01); *B65H 29/125* (2013.01); *B65H 29/70* (2013.01);
(Continued)

(58) Field of Classification Search
CPC ..... G03G 15/6582
(Continued)

(56) References Cited

U.S. PATENT DOCUMENTS 5,201,517 A * 4/1993 Stemmle ..... B65H 29/38 270/58.07
7,192,020 B2 3/2007 Hayashi et al.
(Continued)

FOREIGN PATENT DOCUMENTS

JP 2010-018439 1/2010

OTHER PUBLICATIONS

Non-Final Office Action for U.S. Appl. No. 14/640,104 dated Dec. 24, 2015.
(Continued)

*Primary Examiner* — Anthony Nguyen
(74) *Attorney, Agent, or Firm* — Amin, Turocy & Watson LLP

(57) ABSTRACT

According to one embodiment, a sheet post-processing apparatus includes a standby unit, a processing unit, and a discharge unit. The standby unit puts a sheet on standby. The processing unit is disposed below the standby unit. The processing unit includes a conveyance reference plane, a distance between which and a conveyance reference plane for the sheet in the standby unit changes to decrease from an upstream side toward a downstream side in a conveying direction of the sheet. The processing unit processes the sheet supplied from the standby unit. The discharge unit is disposed on the downstream side in the conveying direction of each of the standby unit and the processing unit. The discharge unit is provided with an opening section for causing the sheet discharged from the standby unit or the processing unit to pass.

10 Claims, 6 Drawing Sheets

(51) Int. Cl.
*B65H 29/70* (2006.01)
*B65H 31/02* (2006.01)
*B65H 31/30* (2006.01)

(52) U.S. Cl.
CPC ..... *B65H 31/02* (2013.01); *B65H 31/3018* (2013.01); *G03G 15/6541* (2013.01); *G03G 15/6552* (2013.01); *G03G 15/6573* (2013.01); *B65H 2301/4212* (2013.01); *B65H 2301/4213* (2013.01); *B65H 2301/5122* (2013.01); *B65H 2301/51214* (2013.01); *B65H 2801/27* (2013.01)

(58) Field of Classification Search
USPC ..... 399/407
See application file for complete search history.

(56) References Cited

U.S. PATENT DOCUMENTS 7,426,366 B2 * 9/2008 Shishikura ..... G03G 15/6573 399/397
7,706,737 B2 * 4/2010 Lang ..... B41J 3/54 271/184
7,748,703 B2 7/2010 Schererz et al.
7,997,577 B2 8/2011 Oshiro et al.
8,496,239 B2 7/2013 Furuhashi et al.
8,622,390 B2 1/2014 Soga et al.
8,733,753 B2 5/2014 Soga et al.
8,888,088 B2 11/2014 Kimata
8,991,817 B1 3/2015 Terao et al.
2004/0183249 A1 * 9/2004 Sato ..... B65H 29/001 271/220
2005/0152725 A1 7/2005 Mochizuki
2007/0001394 A1 1/2007 Ikeda
2008/0181701 A1 7/2008 Fukasawa et al.
2008/0182740 A1 * 7/2008 Fukasawa ..... B65H 45/18 493/405
2010/0150636 A1 6/2010 Kubota et al.
2010/0209164 A1 * 8/2010 Tanaka ..... B65H 29/14 399/407
2010/0254782 A1 10/2010 Yonekawa et al.
2011/0076078 A1 3/2011 Yoshida
2011/0218092 A1 9/2011 Ishii et al.
2012/0119431 A1 * 5/2012 Kobayashi ..... B65H 3/44 271/3.19
2013/0049280 A1 * 2/2013 Soga ..... G03G 15/6552 271/3.14
2013/0301089 A1 * 11/2013 Arikawa ..... B65H 5/062 358/498
2014/0110896 A1 * 4/2014 Ishikawa ..... B65H 29/52 271/3.18
2015/0021374 A1 * 1/2015 Kubo ..... B65H 37/04 227/39
2015/0037120 A1 2/2015 Kubo et al.

OTHER PUBLICATIONS

Non-Final Office Action for U.S. Appl. No. 15/633,985 dated Oct. 6, 2017.

* cited by examiner

SHEET POST-PROCESSING APPARATUS AND IMAGE FORMING SYSTEM

CROSS-REFERENCE TO RELATED APPLICATIONS

This application is a Continuation of application Ser. No. 14/640,104 filed on Mar. 6, 2015, the entire contents of which are incorporated herein by reference.

FIELD

Embodiments described herein relate generally to a sheet post-processing apparatus and an image forming system.

BACKGROUND

There is a sheet post-processing apparatus that applies post-processing such as sorting and stapling to a plurality of sheets conveyed from an image forming apparatus. The sheet post-processing apparatus includes a plurality of conveying paths for applying different kinds of post-processing to the sheets and a discharge unit in which an opening section for discharging the sheets to the outside is formed. However, if the opening section provided in common to the plurality of conveying paths is increased in size, it is likely that noise such as operation sound leaking to the outside increases.

DETAILED DESCRIPTION

Figure 1:
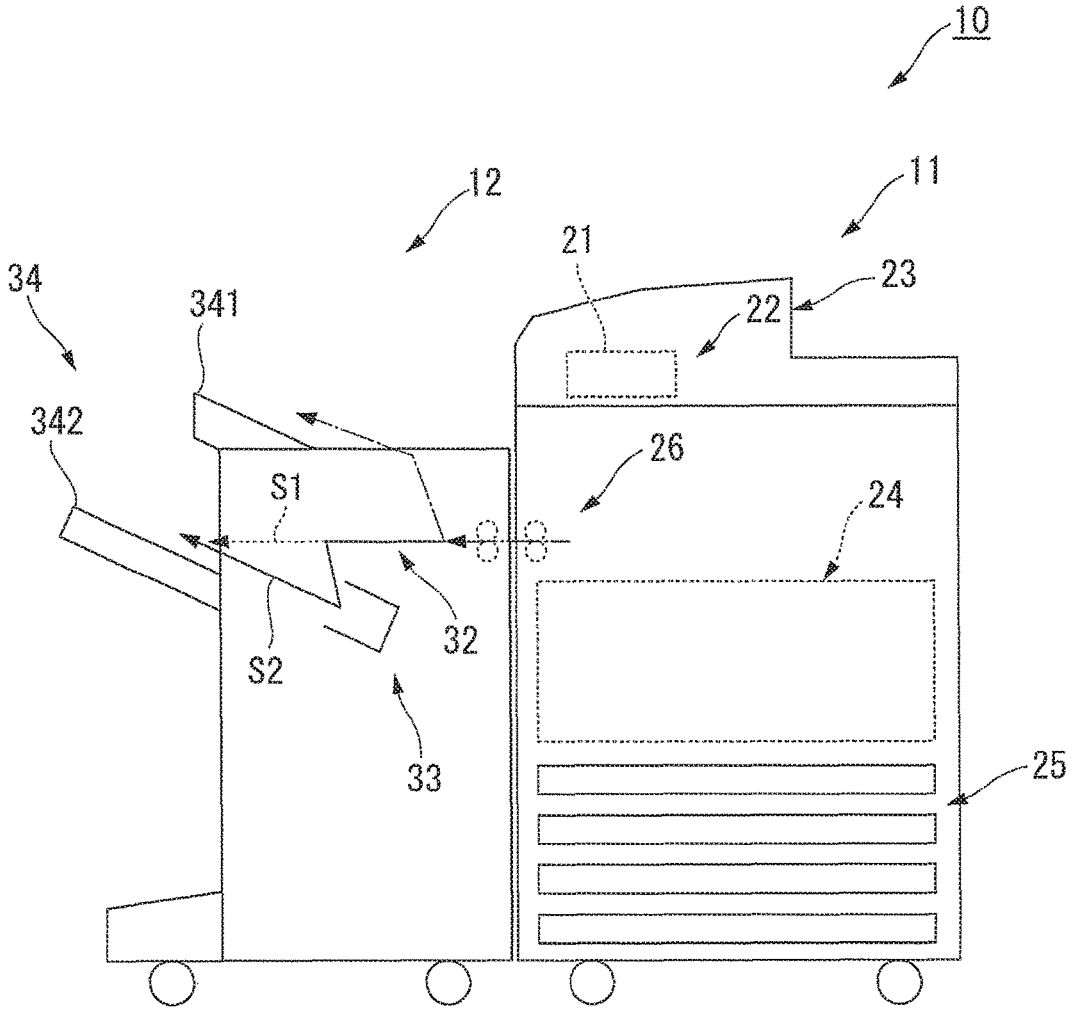
FIG. 1 is a diagram schematically showing an overall configuration example of an image forming apparatus and a sheet post-processing apparatus in an embodiment.

In general, according to one embodiment, a sheet post-processing apparatus includes a standby unit, a processing unit, and a discharge unit. The standby unit puts a sheet on standby. The processing unit is disposed below the standby unit. The processing unit includes a conveyance reference plane, a distance between which and a conveyance reference plane for the sheet in the standby unit changes to decrease from an upstream side toward a downstream side in a conveying direction of the sheet. The processing unit processes the sheet supplied from the standby unit. The discharge unit is disposed on the downstream side in the conveying direction of each of the standby unit and the processing unit. The discharge unit is provided with an opening section for causing the sheet discharged from the standby unit or the processing unit to pass.

An image forming system 10, an image forming apparatus 11, and a sheet post-processing apparatus 12 in an embodiment are explained below with reference to the drawings. Note that, in the figures, the same components are denoted by the same reference numerals and signs.

Figure 2:
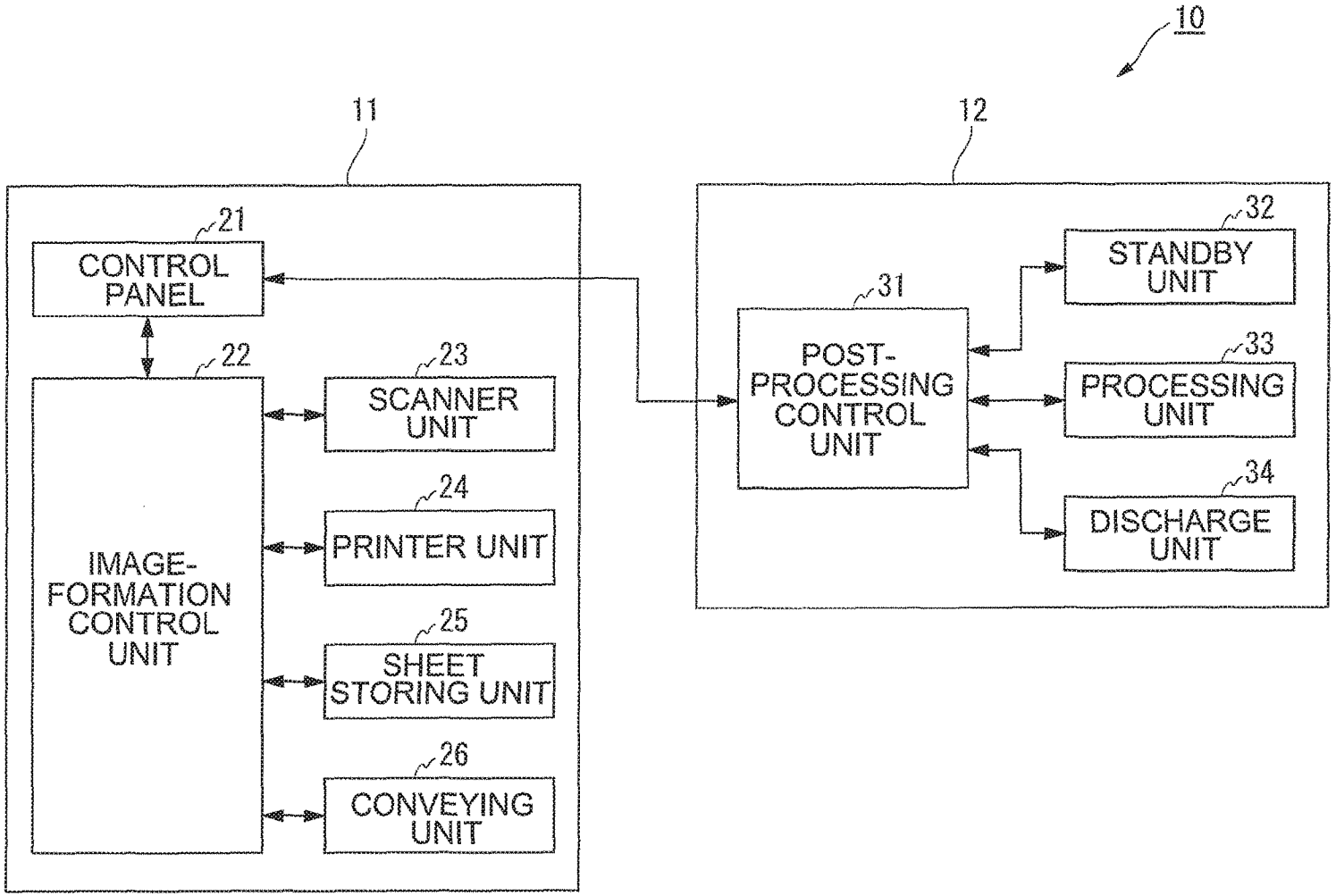
FIG. 2 is a block diagram showing a configuration example of a part of the image forming apparatus and the sheet post-processing apparatus.

FIG. 1 is a diagram schematically showing an overall configuration example of the image forming apparatus 11 and the sheet post-processing apparatus 12 according to the embodiment. FIG. 2 is a block diagram showing a configuration example of a part of the image forming apparatus 11 and the sheet post-processing apparatus 12 according to the embodiment.

As shown in FIGS. 1 and 2, the image forming system 10 includes the image forming apparatus 11 and the sheet post-processing apparatus 12. The image forming apparatus 11 forms an image on a sheet-like medium (hereinafter collectively referred to as "sheet") such as paper. The sheet post-processing apparatus 12 applies post-processing to the sheet discharged from the image forming apparatus 11.

The image forming apparatus 11 includes a control panel 21, an image-formation control unit 22, a scanner unit 23, a printer unit 24, a sheet storing unit 25, and a conveying unit 26.

The control panel 21 includes various keys that receive operation from a user. The control panel 21 includes a display unit that performs various kinds of display. The control panel 21 includes a panel control unit including a CPU, a ROM, and a RAM. The panel control unit receives the operation by the user on the keys and controls the display of the display unit. The control panel 21 displays, on the display unit, various kinds of information such as the number of prints, the size of a sheet, a type of the sheet, and a type of post-processing. The control panel 21 receives designation and a change of the information displayed by the display unit. The control panel 21 receives, for example, designation of information indicating a type of post-processing for a sheet. The control panel 21 outputs the designated information indicating the type of the post-processing for the sheet to the sheet post-processing apparatus 12.

The image-formation control unit 22 controls CPUs of the control panel 21, the scanner unit 23, and the printer unit 24. The image-formation control unit 22 controls the operation of the entire image forming apparatus 11. The image-formation control unit 22 includes a CPU, a ROM, and a RAM.

The scanner unit 23 includes a reading unit that reads image information of a copying target object as contrast of light. The scanner unit 23 includes a scanner control unit including a CPU, a ROM, and a RAM. The scanner control unit controls the reading of the image information by the reading unit. The scanner unit 23 outputs the read image information to the printer unit 24.

The printer unit 24 forms an output image (hereinafter referred to as a toner image) with a developer such as a toner on the basis of the image information received from the scanner unit 23 or image information received from the outside. The printer unit 24 transfers the toner image onto the surface of a sheet. The printer unit 24 applies heat and pressure to the toner image on the surface of the sheet and fixes the toner image on the sheet. The printer unit 24 includes a printer control unit including a CPU, a ROM, and a RAM. The printer control unit controls printing of an image on the sheet by the printer unit 24.

The sheet storing unit 25 supplies sheets to the printer unit 24 one by one to be timed to coincide with the formation of the toner image by the printer unit 24. The sheet storing unit 25 includes a plurality of paper feeding cassettes. The paper feeding cassettes respectively store sheets of sizes and types set in advance. The paper feeding cassettes respectively include pickup rollers. The pickup rollers extract the sheets from the paper feeding cassettes one by one. The pickup rollers supply the extracted sheets to the conveying unit 26.

The conveying unit 26 conveys the sheet supplied from the sheet storing unit 25 to the printer unit 24. The conveying unit 26 conveys the sheet delivered from the printer unit 24 to the sheet post-processing apparatus 12.

The sheet post-processing apparatus 12 is disposed adjacent to the image forming apparatus 11. The sheet post-processing apparatus 12 executes post-processing designated by the control panel 21 on the sheet supplied from the image forming apparatus 11. The sheet post-processing apparatus 12 includes a post-processing control unit 31, a standby unit 32, a processing unit 33, and a discharge unit 34.

The post-processing control unit 31 controls the operation of the entire sheet post-processing apparatus 12. The post-processing control unit 31 includes a CPU, a ROM, and a RAM. During non-sort setting, the post-processing control unit 31 discharges a sheet supplied from the image forming apparatus 11 without sorting the sheet. During the non-sort setting, the post-processing control unit 31 discharges the sheet to a fixed tray 341 or a movable tray 342 of the discharge unit 34. During the non-sort setting, the post-processing control unit 31 directly discharges the sheet to the fixed tray 341. During the non-sort setting, the post-processing control unit 31 discharges the sheet to the movable tray 342 through the standby unit 32. During sort setting, the post-processing control unit 31 sorts a plurality of sheets supplied from the image forming apparatus 11. During staple setting, the post-processing control unit 31 executes stapling (sheet binding) on the plurality of sheets supplied from the image forming apparatus 11. The post-processing control unit 31 aligns the plurality of sheets in the width direction and a conveying direction of the sheet. The post-processing control unit 31 binds together the aligned plurality of sheets. During the sort and staple setting, the post-processing control unit 31 discharges the sheets to the movable tray 342 through the standby unit 32 and the processing unit 33.

During the non-sort setting, the standby unit 32 discharges the sheet supplied from the image forming apparatus 11 to the movable tray 342. The standby unit 32 puts the sheet supplied from the image forming apparatus 11 on standby at predetermined timing during the sort and staple setting. When the next sheet is conveyed to the standby unit 32 anew, if the sheet is being processed in a processing tray 71 or a sheet bundle after the processing is being discharged, the standby unit 32 needs to put the next sheet on standby in a standby tray 66. That is, in order to improve a series of performance of the image formation and the sheet processing, the standby unit 32 needs to put the sheet on standby to secure a sheet processing time in the processing tray 71. The predetermined timing is, for example, a period in which a first predetermined number of sheets among a plurality of sheets, which form a predetermined sheet bundle, are supplied from the image forming apparatus 11. The standby unit 32 puts the predetermined number of sheets on standby at the predetermined timing and then discharges the sheets to the processing unit 33. The standby unit 32 discharges sheets supplied from the image forming apparatuses 11 to the processing unit 33 one by one at timing other than the predetermined timing.

The processing unit 33 aligns a plurality of sheets. The processing unit 33 binds together the aligned plurality of sheets. The processing unit 33 discharges the sheets after the processing to the movable tray 342 of the discharge unit 34.

The discharge unit 34 includes the fixed tray 341 and the movable tray 342. The fixed tray 341 is fixed to an upper part of the sheet post-processing apparatus 12. The movable tray 342 is disposed in a side part of the sheet post-processing apparatus 12. The movable tray 342 is disposed downstream in the conveying direction in each of the standby unit 32 and the processing unit 33. The movable tray 342 moves up and down in the vertical direction of the sheet post-processing apparatus 12.

Figure 3:
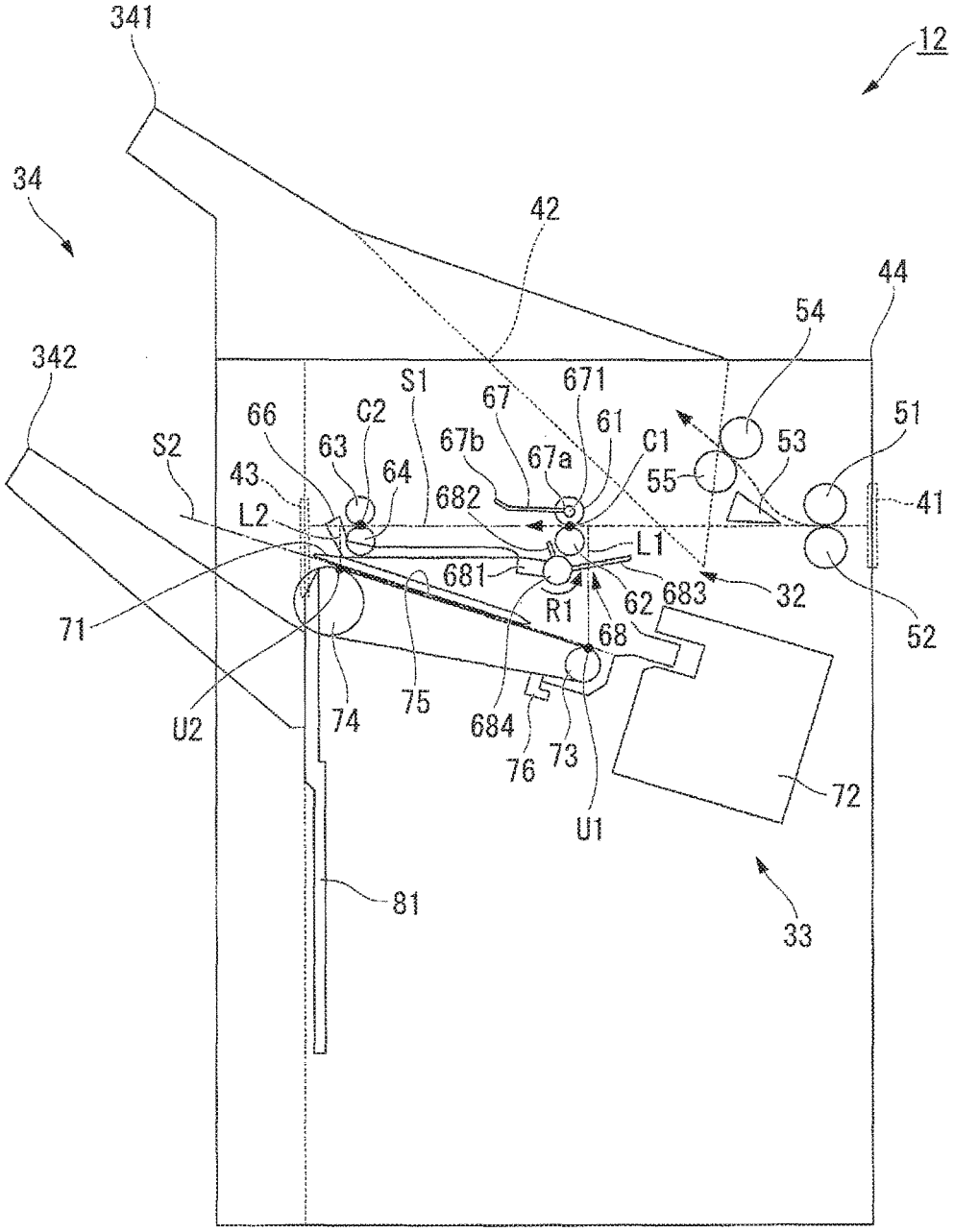
FIG. 3 is a diagram schematically showing a configuration example of a part of the sheet post-processing apparatus.
Figure 4:
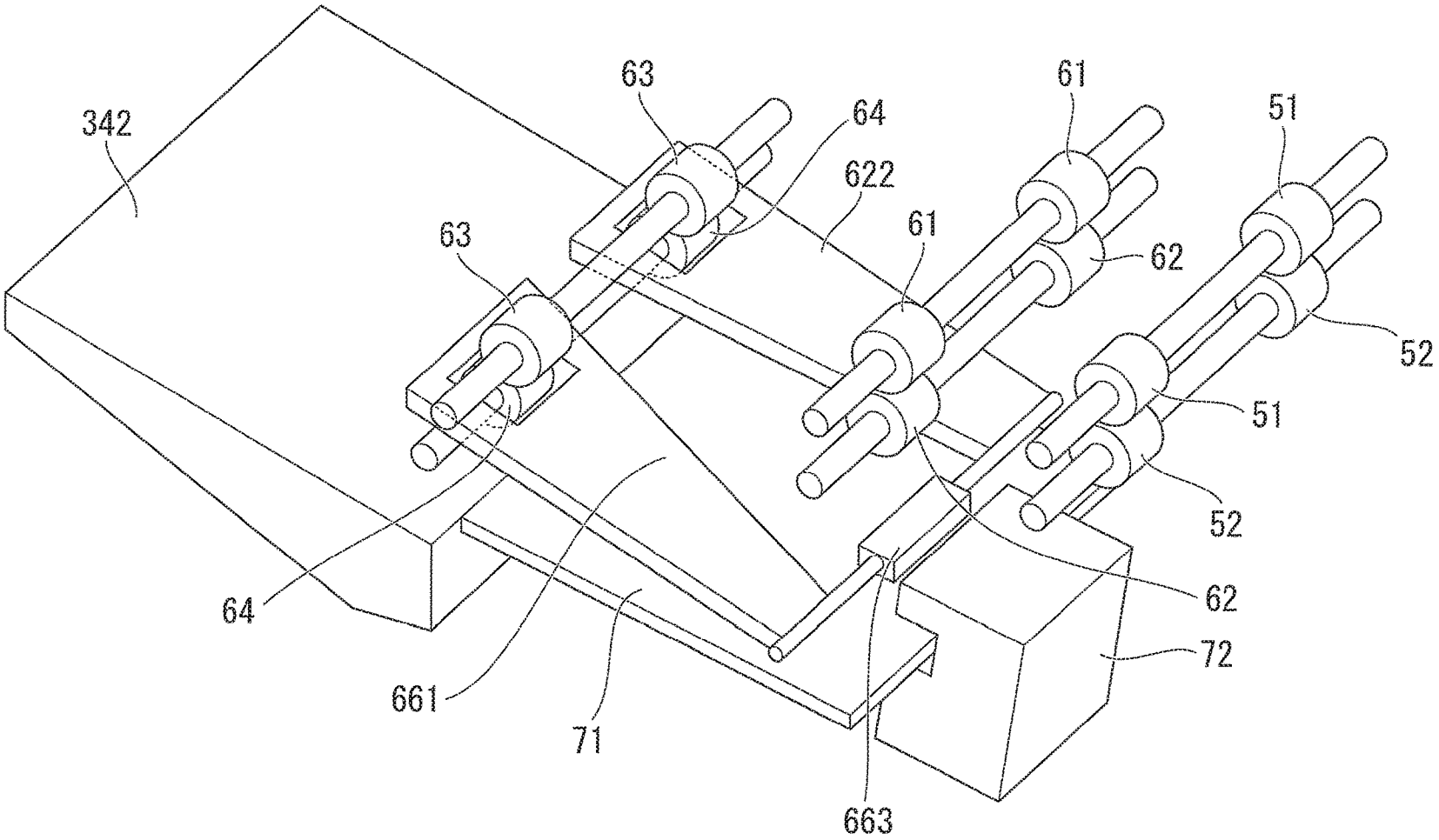
FIG. 4 is a perspective view schematically showing a configuration example of a part of the sheet post-processing apparatus.
Figure 5:
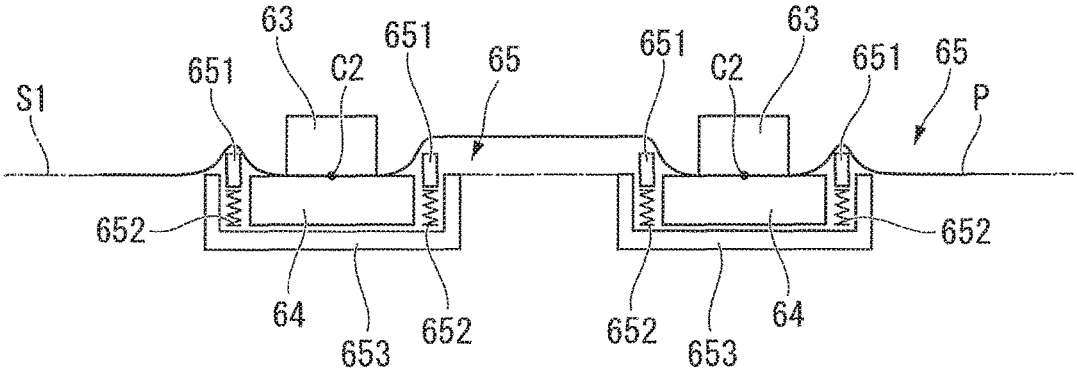
FIG. 5 is a sectional view schematically showing a configuration example of a part of the sheet post-processing apparatus.
Figure 6:
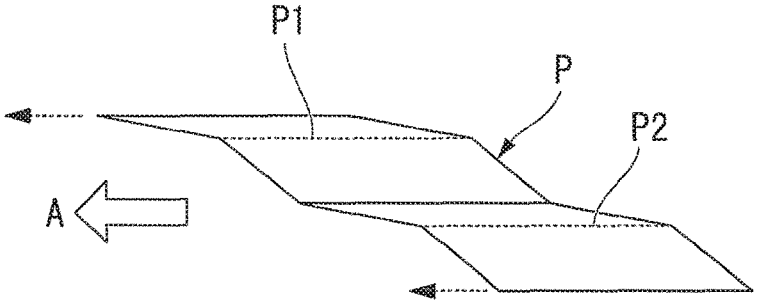
FIG. 6 is a perspective view showing an example of a sheet discharged from the sheet post-processing apparatus.
Figure 7:
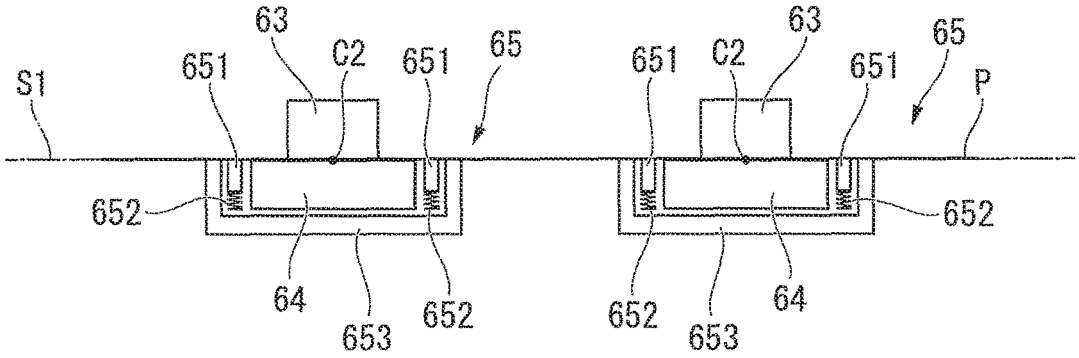
FIG. 7 is a sectional view schematically showing an operation example of a part of the sheet post-processing apparatus.

The configuration of the sheet post-processing apparatus 12 is explained with reference to FIGS. 3, 4, 5, 6, and 7. FIG. 3 is a diagram schematically showing a configuration example of a part of the sheet post-processing apparatus 12 in the embodiment. FIG. 4 is a perspective view schematically showing a configuration example of a part of the sheet post-processing apparatus 12 in the embodiment. FIG. 5 is a sectional view schematically showing a configuration example of a part of the sheet post-processing apparatus 12 in the embodiment. FIG. 6 is a perspective view showing an example of a sheet discharged from the sheet post-processing apparatus 12 in the embodiment. FIG. 7 is a sectional view schematically showing a configuration example of a part of the sheet post-processing apparatus 12 in the embodiment.

The sheet post-processing apparatus 12 includes a housing 44 in which a first opening section 41, a second opening section 42, and a third opening section 43 for causing a sheet to pass. The first opening section 41 causes a sheet supplied from the image forming apparatus 11 to pass toward the inside of the sheet post-processing apparatus 12. The second opening section 42 and the third opening section 43 cause a sheet discharged from the inside to the outside of the sheet post-processing apparatus 12 to pass.

The sheet post-processing apparatus 12 includes a first inlet roller 51 and a second inlet roller 52, a gate flap 53, and a first paper discharge roller 54 and a second paper discharge roller 55. The first inlet roller 51 and the second inlet roller 52 constitute an inlet roller pair. One or plural inlet roller pairs may be provided. The first paper discharge roller 54 and the second paper discharge roller 55 constitute a paper discharge roller pair. One or plural paper discharge roller pairs may be provided. The first inlet roller 51 and the second inlet roller 52 convey a sheet supplied from the image forming apparatus 11 to the gate flap 53. The first inlet roller 51 and the second inlet roller 52 rotate while nipping the sheet from both the sides in the thickness direction. The gate flap 53 switches a conveying destination of the sheet delivered from the first inlet roller 51 and the second inlet roller 52 to the fixed tray 341 or the standby unit 32. The first paper discharge rollers 54 and the second paper discharge roller 55 convey the sheet sent to the fixed tray 341 side by the gate flap 53 to the second opening section 42. The first paper discharge rollers 54 and the second paper discharge roller 55 rotate while nipping the sheet from both the sides in the thickness direction.

The standby unit 32 includes a first outlet roller 61 and a second outlet roller 62, a first buffer roller 63 and a second buffer roller 64, and corrugation forming units 65.

The first outlet roller 61 and the second outlet roller 62 are disposed on the upstream side in the sheet conveying direction in the standby unit 32. In other words, the first outlet roller 61 and the second outlet roller 62 are disposed on the upstream side in the sheet conveying direction of the standby tray 66 explained below. The first outlet roller 61 and the second outlet roller 62 convey the sheet sent from the gate flap 53 to the standby unit 32 side to the first buffer roller 63 and the second buffer roller 64. The first outlet roller 61 and the second outlet roller 62 rotate while nipping the sheet from both the sides in the thickness direction.

The first buffer roller 63 and the second buffer roller 64 are disposed on the downstream side in the sheet conveying direction in the standby unit 32. During the non-sort setting, the first buffer roller 63 and the second buffer roller 64 convey the sheet to the third opening section 43. During the non-sort setting, the first buffer roller 63 and the second buffer roller 64 rotate in a direction for delivering the sheet downstream in the conveying direction while nipping the sheet from both the sides in the thickness direction. During the sort and staple setting, the first buffer roller 63 and the second buffer roller 64 rotate in a direction for delivering the sheet upstream in the conveying direction. During the sort and staple setting, the first buffer roller 63 and the second buffer roller 64 rotate until the trailing end portion of the sheet is supported by a trailing-end supporting unit 68 explained below. During the sort and staple setting, the first buffer roller 63 and the second buffer roller 64 release the nipping of the sheet when the sheet is supplied to the processing unit 33.

In this embodiment, a conveyance reference plane S1 for the sheet in the standby unit 32 is a horizontal plane. The conveyance reference plane S1 is formed by, for example, the first outlet roller 61 and the second outlet roller 62 and the first buffer roller 63 and the second buffer roller 64. The conveyance reference plane S1 includes center positions C1 between the first outlet roller 61 and the second outlet roller 62 and center positions C2 between the first buffer roller 63 and the second buffer roller 64. The center positions C1 between the first outlet roller 61 and the second outlet roller 62 and the center positions C2 between the first buffer roller 63 and the second buffer roller 64 are the same positions in the vertical direction. Note that the conveyance reference plane S1 may be a plane formed by the center positions C1 and a downstream side end portion upper surface Q in the sheet conveying direction of the standby tray 66. In this case, the conveyance reference plane S1 for the sheet is a plane or a horizontal plane on which the position of a downstream side end portion in the sheet conveying direction of the standby tray 66 slightly inclines further downward than the center positions C1.

The corrugation forming units 65 form corrugations in the width direction of the sheet conveyed by the first buffer roller and the second buffer roller 64. In other words, the corrugation forming units 65 bend the sheet to wave as shown in FIG. 6. The corrugation forming units 65 include projecting rollers 651, roller driving units 652, and roller housing units 653. The projecting rollers 651 and the roller driving units 652 are housed on the insides of the roller housing units 653. Note that the roller housing units 653 are configured as a part of a first tray member 661 and a second tray member 662 of the standby tray 66 explained below. The external shape of the roller housing units 653 is formed in, for example, a box shape opened upward. The roller housing units 653 are disposed below the conveyance reference plane S1 including the center positions C2 between the first buffer roller 63 and the second buffer roller 64. The roller housing units 653 house, on the insides, the second buffer roller 64, the projecting rollers 651, and the roller driving units 652. Two projecting rollers 651 and two roller driving units 652 are disposed a predetermined distance apart from the second buffer roller 64 on both the sides in the axial direction of a rotating shaft of the second buffer roller 64. Rotating shafts of the projecting rollers 651 are supported by the roller driving units 652. The roller driving units 652 are elastic members such as springs. The roller driving units 652 include first end portions connected to the bottom surfaces of the roller housing units 653 and second end portions that support the rotating shafts of the projecting rollers 651. The roller driving units 652 apply, with an elastic force in the vertical direction acting between the first end portions and the second end portions, an upward force in the vertical direction to the projecting rollers 651. If the force applied from the roller driving units 652 is larger than the rigidity of a sheet P, the projecting rollers 651 project above the conveyance reference plane S1 while bending the sheet P. As shown in FIG. 6, the two projecting rollers 651 disposed on both the sides of the second buffer roller 64 form two convex portions P1 and P2 in the width direction orthogonal to a conveying direction A of the sheet P. The two convex portions P1 and P2 form the sectional shape of the sheet P with respect to the conveying direction in an M shape. If the force applied from the roller driving units 652 is equal to or smaller than the rigidity of the sheet P, the projecting rollers 651 stay on the inside of the roller housing units 653 below the conveyance reference plane S1.

The projecting rollers 651, the second buffer roller 64, the roller driving units 652, and the roller housing units 653 of the corrugation forming units 65 are built in the tray member 661. The projecting rollers 651, the second buffer roller 64, the roller driving units 652, and the roller housing units 653 and the first ray member 661 are integrally provided (see FIG. 4). The second buffer roller 64 built in the first tray member 661 come into contact with the first buffer roller 63 and convey the sheet downstream or upstream in the conveying direction.

The second tray member 662 includes the projecting rollers 651, the second buffer roller 64, the roller driving units 652, and the roller housing units 653 of the corrugation forming units 65. The second buffer roller 64 built in the second tray member 662 come into contact with the first buffer roller 63 and convey the sheet downstream or upstream in the conveying direction.

The standby unit 32 includes the standby tray 66, an assist arm 67, and the trailing-end supporting unit 68. Note that the standby unit 32 does not always need to include the assist arm 67, the trailing-end supporting unit 68, and the like. The standby unit 32 only has to include at least the standby tray 66.

The standby tray 66 includes the first tray member 661, the second tray member 662, and a tray driving unit 663. The first tray member 661 and the second tray member 662 are disposed a predetermined interval apart from each other in the width direction of the sheet in the standby unit 32. The width direction of the sheet in the standby unit 32 is a direction orthogonal to the conveying direction of the sheet in the standby unit 32. For example, the first tray member 661 and the second tray member 662 are disposed horizontally. The first tray member 661 and the second tray member 662 hold the sheet delivered from the first outlet rollers 61 and the second outlet roller 62. The first tray member 661 and the second tray member 662 stack and hold a plurality of sheets in the thickness direction. The tray driving unit 663 moves the first tray member 661 and the second tray member 662 in synchronization with each other in opposite directions each other in the width direction of the sheet. The tray driving unit 663 includes a gear mechanism such as a rack pinion mechanism and a motor. When the sheet is discharged from the standby unit 32 to the processing unit 33, the tray driving unit 663 moves the first tray member 661 and the second tray member 662 to be separated from each other.

The assist arm 67 shown in FIG. 3 presses the trailing end portion of a top sheet in the stacking direction of the sheets on the standby tray 66 toward the trailing-end supporting unit 68. The assist arm 67 rotates around a rotating shaft 671 coaxial with a rotating shaft of the first outlet rollers 61. The axial direction of the rotating shaft 671 is a direction parallel to the width direction of the sheet in the standby unit 32. The assist arm 67 includes a proximal end portion 67*a* fixed to the rotating shaft 671 and a distal end portion 67*b* disposed downstream in the conveying direction of the sheet in the standby unit 32 from the rotating shaft 671. The distal end portion 67*b* of the assist arm 67 presses the trailing end portion of the top sheet on the standby tray 66 toward the trailing-end supporting unit 68.

The trailing-end supporting unit 68 is disposed upstream of the standby tray 66 in the conveying direction of the standby unit 32 and below the standby tray 66 in the vertical direction. The trailing-end supporting unit 68 includes a pedestal 681, a first paddle 682, a second paddle 683, and a driving shaft 684. The pedestal 681, the first paddle 682, and the second paddle 683 are fixed to the driving shaft 684. The axial direction of the driving shaft 684 is a direction parallel to the width direction of the sheet in the standby unit 32. The pedestal 681 projects in outward in the radial direction from the outer circumferential surface of the driving shaft 684. The shape of each of the pedestal 681, the first paddle 682, and the second paddle 683 is formed in a flat shape. Each of the first paddle 682 and the second paddle 683 is formed of an elastic material such as a rubber material. The projecting length of the first paddle 682 is formed smaller than the projecting length of the pedestal 681. The projecting length of the second paddle 683 is formed larger than the projecting length of the first paddle 682. The projecting length of the second paddle 683 is formed larger than the distance from the outer circumferential surface of the driving shaft 684 to the processing tray 71 explained below. The first paddle 682 is disposed behind the pedestal 681 in a first rotating direction R1 of the pedestal 681. The second paddle 683 is disposed behind the first paddle 682 in the first rotating direction R1 of the pedestal 681.

The trailing-end supporting unit 68 includes a driving belt wound on the outer circumferential surface of the driving shaft 684 and a motor that drives to rotate the driving belt. The driving belt rotates the driving shaft 684 with a driving force output by the motor.

The pedestal 681 supports the trailing end portion in the conveying direction of the sheet placed on the standby tray 66. When the pedestal 681 is supporting the trailing end of the sheet, if the pedestal 681 rotates in the first rotating direction R1 to incline downward, the pedestal 681 drops the held sheet to the processing tray 71. When the first paddle 682 and the second paddle 683 come into contact with the sheet while rotating in the first rotating direction R1, the first paddle 682 and the second paddle 683 rake in the sheet upstream in the conveying direction of the processing unit 33.

The processing unit 33 includes the processing tray 71, a stapler 72, a first conveying roller 73, a second conveying roller 74, a conveyor belt 75, and a bundle discharge guide 76.

The processing tray 71 is disposed below the standby tray 66. The processing tray 71 inclines with respect to the horizontal direction such that the downstream side in the conveying direction of the sheet in the processing unit 33 is higher than the upstream side. A plurality of sheets stacked on the processing tray 71 are aligned in the width direction and the conveying direction of the sheet by an alignment plate or the like.

The stapler 72 is disposed upstream of the processing tray 71 in the conveying direction of the sheet. The stapler 72 applies stapling (binding) to a bundle of a predetermined number of sheets stacked on the processing tray 71.

The first conveying roller 73 and the second conveying roller 74 are disposed a predetermined interval apart from each other in the conveying direction of the sheet in the processing unit 33. The first conveying roller 73 is disposed on the upstream side in the conveying direction of the sheet. The second conveying roller 74 is disposed on the downstream side in the conveying direction of the sheet. The first conveying roller 73 is disposed in a position in the vertical direction relatively lower than the second conveying roller 74.

The conveyor belt 75 is laid over the first conveying roller 73 and the second conveying roller 74. The conveyor belt 75 rotates in synchronization with the first conveying roller 73 and the second conveying roller 74. The conveyor belt 75 conveys the sheet between the stapler 72 and the discharge unit 34.

A conveyance reference plane S2 for the sheet in the processing unit 33 is an inclining surface inclining with respect to the horizontal direction. The conveyance reference plane S2 inclines with respect to the horizontal direction such that the downstream side in the conveying direction of the sheet in the processing unit 33 is higher than the upstream side. The conveyance reference plane S2 is formed by, for example, the first conveying roller 73, the second conveying roller 74, and the conveyor belt 75. The conveyance reference plane S2 includes a sheet placing surface of the conveyor belt 75. An uppermost position U1 in the vertical direction on the outer circumferential surface of the first conveying roller 73 is lower than an uppermost position U2 in the vertical direction on the outer circumferential surface of the second conveying roller 74. The diameter of the second conveying roller 74 is relatively large compared with the diameter of the first conveying roller 73. The second conveying roller 74 projects further outward than the third opening section 43 and a shutter 81 of the discharge unit 34 explained below.

The distance between the conveyance reference plane S1 of the standby unit 32 and the conveyance reference plane S2 of the processing unit 33 changes to decrease from the upstream side toward the downstream side in the conveying direction of the sheet. A distance L2 in the vertical direction between the center positions C2 and the uppermost position U2 is relatively small compared with a distance L1 in the vertical direction between the center positions C1 of the standby unit 32 and the uppermost position U1 of the processing unit 33.

The bundle discharge guide 76 is provided in the conveyor belt 75. The shape of the bundle discharge guide 76 is formed in a claw shape projecting from the surface of the conveyor belt 75. The bundle discharge guide 76 comes into contact with the trailing end portion of a bundle of sheets placed on the conveyor belt 75. The bundle discharge guide 76 conveys the bundle of the sheets on the conveyor belt 75 toward the discharge unit 34 according to the rotation of the conveyor belt 75.

The fixed tray 341 of the discharge unit 34 stacks sheets discharged from the second opening section 42 of the housing 44. The movable tray 342 of the discharge unit 34 stacks sheets discharged from the third opening section 43 of the housing 44. The third opening section 43 is provided on the downstream side in the conveying direction of each of the standby unit 32 and the processing unit 33. The discharge unit 34 includes the shutter 81 that moves up and down with respect to the third opening section 43. During the non-sort setting, the shutter 81 moves up in order to close a part of the third opening section 43. The shutter 81 moves up to thereby prevent the front end portion in the conveying direction of the processing tray 71 from being exposed to the outside from the third opening section 43. During the sort and staple setting, the shutter 81 moves down in order to open the entire third opening section 43. The shutter 81 moves down to thereby expose the front end portion in the conveying direction of the processing tray 71 to the outside from the third opening section 43.

The sheet post-processing apparatus 12 in the embodiment explained above includes the conveyance reference planes S1 and S2, the distance between which decreases on the downstream side in the conveying direction. Therefore, the third opening section 43 can be narrowed. Since the sheet post-processing apparatus 12 includes the third opening section 43 narrowed according to the conveyance reference planes S1 and S2, it is possible to reduce noise such as operation sound leaking to the outside.

Since the sheet post-processing apparatus 12 includes the standby unit 32 and the processing unit 33 having the distance L2 relatively small compared with the distance L1, it is possible to reduce the distance between the conveyance reference planes S1 and S2 on the downstream side in the conveying direction.

Since the sheet post-processing apparatus 12 includes the standby unit 32 including the horizontal conveyance reference plane S1, it is possible to reduce, on the downstream side in the conveying direction, the distance between the conveyance reference plane S1 and the conveyance reference plane S2 inclining with respect to the horizontal direction.

Since the sheet post-processing apparatus 12 includes the corrugation forming units 65, it is possible to prevent the sheet from curling up and down from the conveying direction. Since the sheet post-processing apparatus 12 includes the two projecting rollers 651, it is possible to form the two convex portions P1 and P2 in the width direction of the sheet and prevent the sheet from curling up and down from the conveying direction. Since the sheet post-processing apparatus 12 includes the roller driving units 652 that project the projecting rollers 651 upward from the conveyance reference plane S1 with an elastic force, it is possible to simplify the configuration of the corrugation forming units 65.

Since the sheet post-processing apparatus 12 includes the second conveying roller 74 projecting further outward than the third opening section 43, it is possible to prevent the trailing end portion of the sheet discharged to the movable tray 342 from remaining in the standby unit 32.

Modifications of the embodiment are explained below.

In the embodiment, during the non-sort setting, the standby unit 32 discharges the sheet supplied from the image forming apparatus 11 to the movable tray 342. However, the standby unit 32 is not limited to this.

During the non-sort setting, the standby unit 32 may prohibit the discharge of the sheet from the first buffer roller 63 and the second butter roller 64 to the movable tray 342. The movable tray 342 and the shutter 81 may be fixed in the vertical direction. The third opening section 43 may be provided on the downstream side in the conveying direction of the processing unit 33.

According to this modification, compared with when the sheet is discharged from the standby unit 32 to the movable tray 342, it is possible to narrow the third opening section 43 and reduce noise leaking to the outside. The configuration of the sheet post-processing apparatus 12 can be simplified by omitting a lifting and lowering mechanism for lifting and lowering the movable tray 342 and the shutter 81. It is possible to prevent occurrence of noise due to the moving up and down of the movable tray 342 and the shutter 81.

In the embodiment, the conveyance reference plane S1 for the sheet in the standby unit 32 is explained as the horizontal plane. However, the conveyance reference plane S1 is not limited to this.

The conveyance reference plane S1 of the standby unit 32 may incline with respect to the horizontal direction at inclination smaller than the inclination of the conveyance reference plane S2 of the processing unit 33.

In the embodiment, the corrugation forming units 65 are explained as including the projecting rollers 651 that project upward from below the conveyance reference plane S1. However, the corrugation forming units 65 are not limited to this.

The corrugation forming units 65 may include projecting rollers that project downward from above the conveyance reference plane S1. The corrugation forming units 65 may include roller housing units that house the projecting rollers above the conveyance reference plane S1. The corrugation forming units 65 may include two projecting rollers disposed a predetermined distance apart from the first buffer roller 63 on both the sides in the axial direction of the rotating shaft of the first buffer roller 63. The corrugation forming units 65 may form, with the two projecting rollers on both the sides of the first buffer roller 63, a corrugation, the sectional shape of which with respect to the conveying direction of the sheet is a W shape. According to this modification, it is possible to prevent the sheet from curling up and down from the conveying direction.

In the embodiment, the corrugation forming units 65 are explained as forming corrugations with the first buffer roller 63 and the second buffer roller 64. However, the corrugation forming units 65 are not limited to this.

The corrugation forming units 65 may form corrugations on the sheet in other positions in the standby unit 32.

In the embodiment, the diameter of the second conveying roller 74 is explained as being relatively large compared with the diameter of the first conveying roller 73. However, the diameter of the second conveying roller 74 is not limited to this.

The diameter of the second conveying roller 74 and the diameter of the first conveying roller 73 may be the same size.

According to at least one embodiment explained above, the sheet post-processing apparatus 12 includes the conveyance reference planes S1 and S2, the distance between which decreases on the downstream side in the conveying direction. Therefore, it is possible to narrow the third opening section 43. Since the sheet post-processing apparatus 12 includes the third opening section 43 that narrows according to the conveyance reference planes S1 and S2, it is possible to reduce noise such as operation sound leaking to the outside.

While certain embodiments have been described, these embodiments have been presented byway of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet post-processing apparatus comprising:

a standby unit configured to put a sheet on standby, the standby unit including a tray member on which the sheet is placed;

a corrugation forming unit configured to form a corrugation in a direction orthogonal to a conveying direction on the sheet in the standby unit, the corrugation forming unit integrally provided with the tray member;

a processing unit disposed below the standby unit and configured to process the sheet supplied from the standby unit;

a plurality of first rollers configured to form a conveyance reference plane in the standby unit and convey the sheet; and a plurality of second rollers configured to form a conveyance reference plane in the processing unit and convey the sheet, wherein a distance between the first roller downstream in the conveying direction in the standby unit among the plurality of first rollers and the second roller downstream in the conveying direction in the processing unit among the plurality of second rollers is relatively smaller than a distance in a vertical direction between the first roller upstream in the conveying direction in the standby unit among the plurality of first rollers and the second roller upstream in the conveying direction in the processing unit among the plurality of second rollers, and wherein the corrugation forming unit includes:

a first roller configured to convey the sheet in the standby unit; and a projecting roller projecting upward from the conveyance reference plane in the standby unit in a position shifting from the first roller in a rotation axis direction of the first roller.

2. The apparatus according to claim 1, wherein the conveyance reference plane in the standby unit is a horizontal plane.

3. The apparatus according to claim 1, wherein the corrugation forming unit includes a plurality of the projecting rollers disposed in positions at both end portions of the first roller in the rotation axis direction of the first roller.

4. The apparatus according to claim 1, further comprising:

a housing unit configured to house the projecting roller below the conveyance reference plane; and an elastic member configured to urge the projecting roller upward and project the projecting roller upward from the conveyance reference plane.

5. A sheet post-processing apparatus comprising:

a standby unit configured to put a sheet on standby, the standby unit including a tray member on which the sheet is placed;

a corrugation forming unit configured to form a corrugation in a direction orthogonal to a conveying direction on the sheet in the standby unit, the corrugation forming unit integrally provided with the tray member;

a processing unit disposed below the standby unit and configured to process the sheet supplied from the standby unit; and a plurality of rollers configured to form a conveyance reference plane in the processing unit and convey the sheet, wherein in the plurality of rollers, a diameter of the roller most downstream in the conveying direction in the processing unit is relatively larger than a diameter of the rollers other than the most downstream roller.

6. The apparatus according to claim 5, further comprising a discharge unit disposed on the downstream side in the conveying direction of the processing unit and provided with an opening section allowing the sheet discharged from the processing unit to pass therethrough, wherein the most downstream roller projects further outward than the discharge unit.

7. The apparatus according to claim 6, wherein the discharge unit is disposed on the downstream side in the conveying direction of the standby unit and is provided with the opening section allowing the sheet discharged from the standby unit to pass therethrough.

8. The apparatus according to claim 1, wherein the standby unit is configured to drop the held sheet on standby onto the processing unit.

9. The apparatus according to claim 1, wherein the standby unit comprises:

a first tray member and a second tray member on which the sheet is placed; and a tray driving unit configured to move the first tray member and the second tray member to be separated from each other.

10. An image forming system comprising:

a sheet post-processing apparatus;

an image forming unit configured to form an image on a sheet; and a conveying unit configured to convey the sheet, on which the image is formed, to the sheet post-processing apparatus, wherein the sheet post-processing apparatus comprises:

a standby unit configured to put a sheet on standby, the standby unit including a tray member on which the sheet is placed;

a corrugation forming unit configured to form a corrugation in a direction orthogonal to a conveying direction on the sheet in the standby unit, the corrugation forming unit integrally provided with the tray member;

a processing unit disposed below the standby unit and configured to process the sheet supplied from the standby unit;

a plurality of first rollers configured to form a conveyance reference plane in the standby unit and convey the sheet; and a plurality of second rollers configured to form a conveyance reference plane in the processing unit and convey the sheet, wherein a distance between the first roller downstream in the conveying direction in the standby unit among the plurality of first rollers and the second roller downstream in the conveying direction in the processing unit among the plurality of second rollers is relatively smaller than a distance in a vertical direction between the first roller upstream in the conveying direction in the standby unit among the plurality of first rollers and the second roller upstream in the conveying direction in the processing unit among the plurality of second rollers, and wherein the corrugation forming unit includes:

a first roller configured to convey the sheet in the standby unit; and a projecting roller projecting upward from the conveyance reference plane in the standby unit in a position shifting from the first roller in a rotation axis direction of the first roller.

* * * * *